US008905504B2

(12) United States Patent
Iizawa

(10) Patent No.: US 8,905,504 B2
(45) Date of Patent: Dec. 9, 2014

(54) LIQUID ACCOMMODATION MEMBER, LIQUID ACCOMMODATION MEMBER UNIT AND LIQUID CONSUMPTION DEVICE

(71) Applicant: Seiko Epson Corporation, Tokyo (JP)

(72) Inventor: Keigo Iizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/045,322

(22) Filed: Oct. 3, 2013

(65) Prior Publication Data

US 2014/0104347 A1 Apr. 17, 2014

(30) Foreign Application Priority Data

Oct. 16, 2012 (JP) ..... 2012-228640

(51) Int. Cl.
*B41J 2/195* (2006.01)
*B41J 2/175* (2006.01)

(52) U.S. Cl.
CPC .... *B41J 2/17566* (2013.01); *B41J 2002/17573* (2013.01); *B41J 2/17513* (2013.01)
USPC ..... 347/7; 347/86

(58) Field of Classification Search
CPC ..... B41J 2/17503; B41J 2/17506; B41J 2/17513; B41J 2/17523; B41J 2/17553; B41J 2/17566; B41J 2/17573; B41J 2/17576
USPC ..... 347/7, 19, 85, 86; 73/293
See application file for complete search history.

(56) References Cited

U.S. PATENT DOCUMENTS

| | | | | |
|---|---|---|---|---|
| 6,293,143 | B1 * | 9/2001 | Denton et al. | 73/293 |
| 6,378,971 | B1 * | 4/2002 | Tamura et al. | 347/7 |
| 6,893,118 | B2 * | 5/2005 | Murakami et al. | 347/84 |
| 7,354,494 | B2 * | 4/2008 | Miyajima et al. | 156/64 |
| 8,016,376 | B2 * | 9/2011 | Sugahara | 347/7 |
| 2008/0198188 | A1 | 8/2008 | Umeda | |
| 2011/0074843 | A1 | 3/2011 | Kusaka | |
| 2012/0050359 | A1 | 3/2012 | Koganehira et al. | |

FOREIGN PATENT DOCUMENTS

| | | |
|---|---|---|
| JP | 06-106730 | 4/1994 |
| JP | 11-240167 | 9/1999 |
| JP | 2004-142325 | 5/2004 |
| JP | 2008-200955 | 9/2008 |
| JP | 2008-273039 | 11/2008 |
| JP | 2012-066563 | 4/2012 |

* cited by examiner

*Primary Examiner* — Anh T. N. Vo
(74) *Attorney, Agent, or Firm* — Workman Nydegger

(57) ABSTRACT

A liquid accommodation member includes a liquid accommodation chamber, a liquid outlet port that is capable of leading the liquid to a liquid consumption portion from the liquid accommodation chamber, a liquid inlet port through which the liquid is capable of being injected into the liquid accommodation chamber, a visual recognition surface through which a liquid level of the liquid accommodated in the liquid accommodation chamber is capable of being visually recognized, an illumination portion that illuminates the liquid accommodation chamber, and a displacement member that is displaced between a time of liquid injection at which the liquid is injected through the liquid inlet port and a time of liquid non-injection at which the liquid is not injected. The illumination portion lights up when the displacement member is displaced from a liquid non-injection position at which the displacement member is located at the time of the liquid non-injection.

5 Claims, 6 Drawing Sheets

LIQUID ACCOMMODATION MEMBER, LIQUID ACCOMMODATION MEMBER UNIT AND LIQUID CONSUMPTION DEVICE

BACKGROUND

1. Technical Field

The present invention relates to a liquid consumption device such as an ink jet printer, for example, a liquid accommodation member that accommodates liquid to be consumed by the liquid consumption device, and a liquid accommodation member unit including the liquid accommodation member.

2. Related Art

An existing ink jet printer including an ink tank (liquid accommodation member) capable of accommodating ink to be consumed by an ejecting head (liquid consumption portion) that ejects ink (liquid) has been known (for example, JP-A-2012-66563) in the past.

Normally, a check window (visual recognition surface) through which a position of a liquid level of the ink accommodated in the ink tank can be visually recognized is provided on the ink tank included in such printer.

Incidentally, If the wall surface in the ink tank is wet with ink or ink of a deep color is accommodated in the ink tank, for example, it has been difficult to visually recognize the position of the liquid level of the ink. In particular, when an ink tank into which ink can be injected is used, if ink of equal to or larger than an accommodation amount is injected while the position of the liquid level of the ink cannot be visually recognized at the time of the injection, there arises a risk that the ink is spilled out to contaminate the periphery thereof.

Note that the problem has arisen substantially commonly not only on the ink tank included in the ink jet printer but also on liquid accommodation members for accommodating liquids.

SUMMARY

An advantage of some aspects of the invention is to provide a liquid accommodation member, a liquid accommodation member unit, and a liquid consumption device including the liquid accommodation member that make it possible to visually recognize a position of a liquid level of liquid accommodated in the liquid accommodation member easily at the time of liquid injection.

Hereinafter, methods for achieving the above-mentioned object and action effects thereof are described.

A liquid accommodation member according to an aspect of the invention includes a liquid accommodation chamber that accommodates liquid to be supplied to a liquid consumption portion for consuming the liquid, a liquid outlet port that is capable of leading the liquid to the liquid consumption portion from the liquid accommodation chamber, a liquid inlet port through which the liquid is capable of being injected into the liquid accommodation chamber from the outside, a visual recognition surface through which a liquid level of the liquid accommodated in the liquid accommodation chamber is capable of being visually recognized, an illumination portion that illuminates the liquid accommodation chamber, and a displacement member that is displaced between a time of liquid injection at which the liquid is injected through the liquid inlet port and a time of liquid non-injection at which the liquid is not injected. In the liquid accommodation member, the illumination portion lights up when the displacement member is displaced from a liquid non-injection position at which the displacement member is located at the time of the liquid non-injection.

With this configuration, when the liquid is injected into the liquid accommodation chamber through the liquid inlet port, the displacement member is displaced from the liquid non-injection position. Further, the illumination portion lights up when the displacement member is displaced from the liquid non-injection position. Therefore, the illumination portion illuminates the liquid accommodation chamber at that time. This makes it possible to visually recognize a position of a liquid level of the liquid accommodated in the liquid accommodation member easily at the time of the liquid injection.

In the liquid accommodation member according to the aspect of the invention, it is preferable that the illumination portion illuminate the liquid accommodation chamber toward a side of the visual recognition surface from a side opposite to the visual recognition surface with respect to the liquid accommodation chamber.

With this configuration, the illumination portion illuminates the liquid accommodation chamber toward the side of the visual recognition surface from the position at the rear side when seen from the side of the visual recognition surface. Therefore, a light amount reaching the visual recognition surface can be increased in comparison with a case where the liquid accommodation chamber is illuminated from another position. This makes it possible to visually recognize the position of the liquid level of the liquid accommodated in the liquid accommodation member more easily.

A liquid accommodation member unit according to another aspect of the invention includes at least two liquid accommodation members each of which includes a liquid accommodation chamber that accommodates liquid to be supplied to a liquid consumption portion for consuming the liquid, a liquid outlet port that is capable of leading the liquid to the liquid consumption portion from the liquid accommodation chamber, a liquid inlet port through which the liquid is capable of being injected into the liquid accommodation chamber from the outside, and a visual recognition surface through which a liquid level of the liquid accommodated in the liquid accommodation chamber is capable of being visually recognized, an illumination portion that illuminates each liquid accommodation chamber, and a displacement member that is displaced between a time of liquid injection at which the liquid is injected through the liquid inlet port and a time of liquid non-injection at which the liquid is not injected. In the liquid accommodation member unit, the illumination portion lights up when the displacement member is displaced from a liquid non-injection position at which the displacement member is located at the time of the liquid non-injection.

With this configuration, the illumination portion lights up when the displacement member is displaced from the liquid non-injection position. Therefore, the illumination portion illustrates each liquid accommodation chamber when the liquid is injected into the liquid accommodation chamber. This makes it possible to visually recognize the position of the liquid level of the liquid accommodated in each liquid accommodation member for each of the liquid accommodation members easily at the time of the liquid injection into at least two liquid accommodation members.

In the liquid accommodation member unit according to the aspect of the invention, it is preferable that the illumination portion and the displacement member be provided so as to correspond to each of at least two liquid accommodation members individually, and in at least two illumination portions, the illumination portion for illuminating the liquid accommodation member corresponding to the displacement member that is displaced from the liquid non-injection position in at least two displacement members light up.

With this configuration, the illumination portion corresponding to the liquid accommodation member of which displacement member is displaced from the liquid non-injection position in at least two liquid accommodation members lights up. Therefore, the illumination portions light up selectively so as to visually recognize the position of the liquid level of the liquid accommodated in the liquid accommodation member into which the liquid is injected while ensuring power saving performance.

Further, a liquid consumption device according to still another aspect of the invention includes a liquid consumption portion for consuming liquid, a liquid accommodation chamber that accommodates the liquid to be supplied to the liquid consumption portion, a liquid outlet port that is capable of leading the liquid to the liquid consumption portion from the liquid accommodation chamber, a liquid inlet port through which the liquid is capable of being injected into the liquid accommodation chamber from the outside, a visual recognition surface through which a liquid level of the liquid accommodated in the liquid accommodation chamber is capable of being visually recognized, an illumination portion that illuminates the liquid accommodation chamber, and a displacement member that is displaced between a time of liquid injection at which the liquid is injected through the liquid inlet port and a time of liquid non-injection at which the liquid is not injected. In the liquid consumption device, the illumination portion lights up when the displacement member is displaced from a liquid non-injection position at which the displacement member is located at the time of the liquid non-injection.

With this configuration, the same action effects as those obtained by the above-mentioned aspect relating to the liquid accommodation member are obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a recording device as an example of a liquid consumption device is described with reference to the accompanying drawings.

Figure 1:
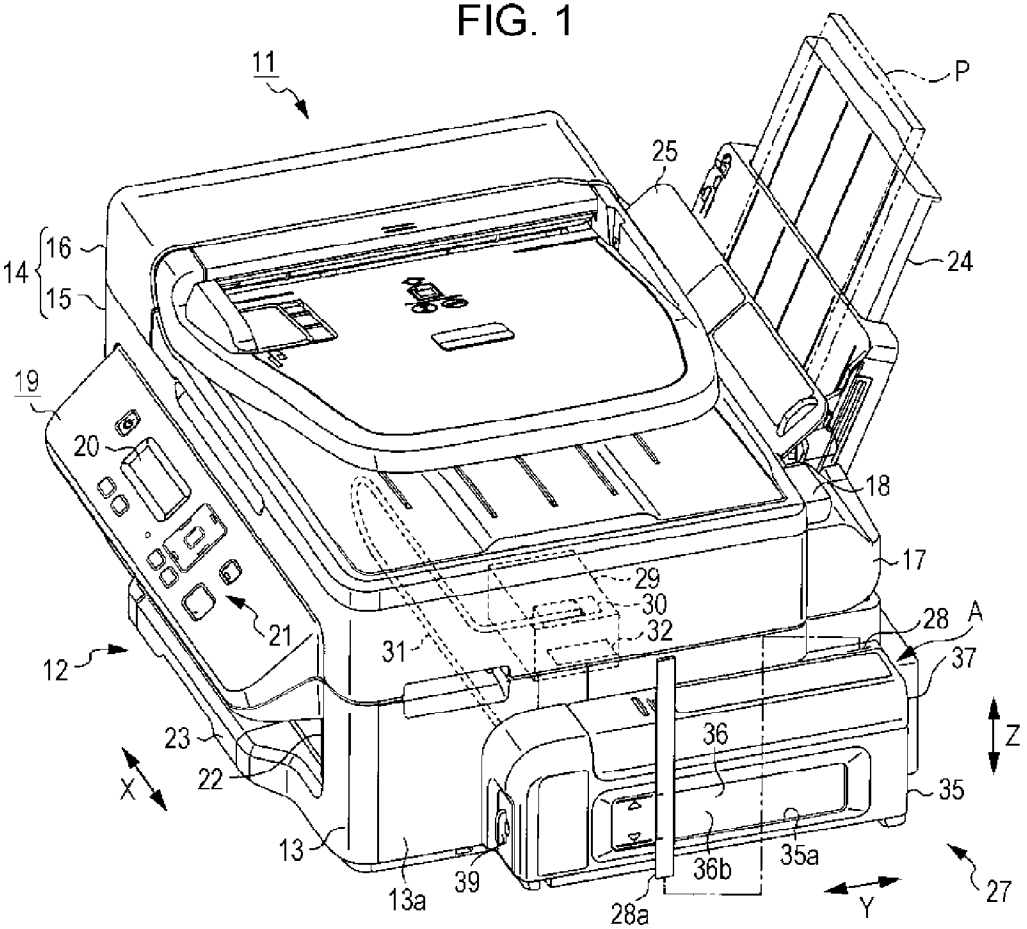
FIG. 1 is a perspective view illustrating a complex machine according to a first embodiment.

As illustrated in FIG. 1, a complex machine 11 includes a recording device 12 and a scanner unit 14. The scanner unit 14 is mounted on a device main body 13 of the recording device 12.

The recording device 12 can perform recording onto paper P and the scanner unit 14 can read an image and the like recorded on a document. In the present specification, the antigravity direction is referred to as the upward direction and the gravity direction is referred to as the downward direction. In the drawings, the direction along the upward direction and the downward direction is set as the up-down direction Z as an example of the vertical direction.

The scanner unit 14 includes a scanner main body portion 15 and a transportation unit 16. A part of the scanner main body portion 15 is coupled to the device main body 13 of the recording device 12 in a rotationally movable manner. The transportation unit 16 is arranged above the scanner main body portion 15. The scanner main body portion 15 is attached to the recording device 12 through a rotating mechanism 17 such as a hinge that is provided on one end of the scanner main body portion 15. The scanner main body portion 15 is attached so as to be displaced between a close position at which the scanner main body portion 15 covers an upper portion of the device main body 13 and an open position at which the scanner main body portion 15 opens the upper portion of the device main body 13. The transportation unit 16 is attached to the scanner main body portion 15 through a rotating mechanism 18 such as a hinge that is provided on one end of the transportation unit 16. The transportation unit 16 is attached so as to be displaced between a position at which the transportation unit 16 covers an upper portion of the scanner main body portion 15 and a position at which the transportation unit 16 opens the upper portion of the scanner main body portion 15.

In the following description, on the complex machine 11, the side at which the rotating mechanisms 17 and 18 are provided is referred to as the rear side or the rear surface side and the opposite side thereto is referred to as the front side. In the drawings, the direction along the front direction and the rear direction is set as the front-rear direction Y. The front end sides of the scanner unit 14, the scanner main body portion 15, and the transportation unit 16 are rotationally movable upward.

Further, in the drawings, the direction along the right direction and the left direction when the rear direction is seen from the front side (front view) is set as the right-left direction X. It is to be noted that the right-left direction X, the front-rear direction Y, and the up-down direction Z intersect with one another (in the embodiment, are orthogonal to one another). Accordingly, the right-left direction X and the front-rear direction Y in the embodiment are the directions along the horizontal direction.

An operation panel 19 is arranged at the front surface side of the complex machine 11. The operation panel 19 includes a display portion (for example, liquid crystal display) 20 and various operation buttons 21. The display portion 20 displays a menu screen and the like. The operation buttons 21 are provided at the periphery of the display portion 20.

A discharge port 22 for discharging the paper P from the device main body 13 is opened on a lower portion of the operation panel 19 on the recording device 12. Further, a paper discharge table 23 capable of being drawn out is accommodated on a lower portion of the discharge port 22 on the recording device 12.

A slide-out medium supporting member 24 is attached to the rear surface side of the recording device 12. A plurality of pieces of paper P can be loaded on the medium supporting member 24 and the medium supporting member 24 has a substantially rectangular plate-like shape. Further, an inlet port cover 25 is attached to the rear portion of the scanner main body portion 15. The inlet port cover 25 is movable rotationally about the base end (in the embodiment, front end) thereof.

Further, a tank unit 27 is fixed to an attachment surface 13*a*, which is the right side surface of the device main body 13 at the outer side. The tank unit 27 accommodates ink (an example of liquid). A scale accommodation portion 28 accommodating a scale 28*a* is provided at a position between the device main body 13 and the tank unit 27 and at a position closer to the rear potion of the attachment surface 13*a*. The scale accommodation portion 28 is formed on the attachment surface 13*a* in a recessed manner. The scale accommodation portion 28 is formed so as to form a rectangular groove that has the depth corresponding to the thickness of the scale 28*a* in the right-left direction X, has the width corresponding to the width of the scale 28*a* in the front-rear direction Y, and is elongated in the up-down direction Z.

On the other hand, a carriage 29 and a relay adapter 30 are provided in the device main body 13. The carriage 29 is held in a state of being capable of reciprocating in the right-left direction X as the main scanning direction. The relay adapter 30 is attached to the carriage 29. One end of a tube 31 having flexibility is connected to the relay adapter 30. The other end of the tube 31 is connected to the tank unit 27. Further, a liquid ejecting head 32 is supported on the lower surface of the carriage 29. The liquid ejecting head 32 is an example of a liquid consumption portion capable of ejecting ink supplied from the tank unit 27.

Accordingly, ink accommodated in the tank unit 27 is supplied to the liquid ejecting head 32 through the tube 31 by using a water head difference. The ink supplied to the liquid ejecting head 32 is ejected onto the paper P that is transported by a transportation mechanism (not illustrated), so that recording (an example of liquid consumption) is performed.

Figure 2:
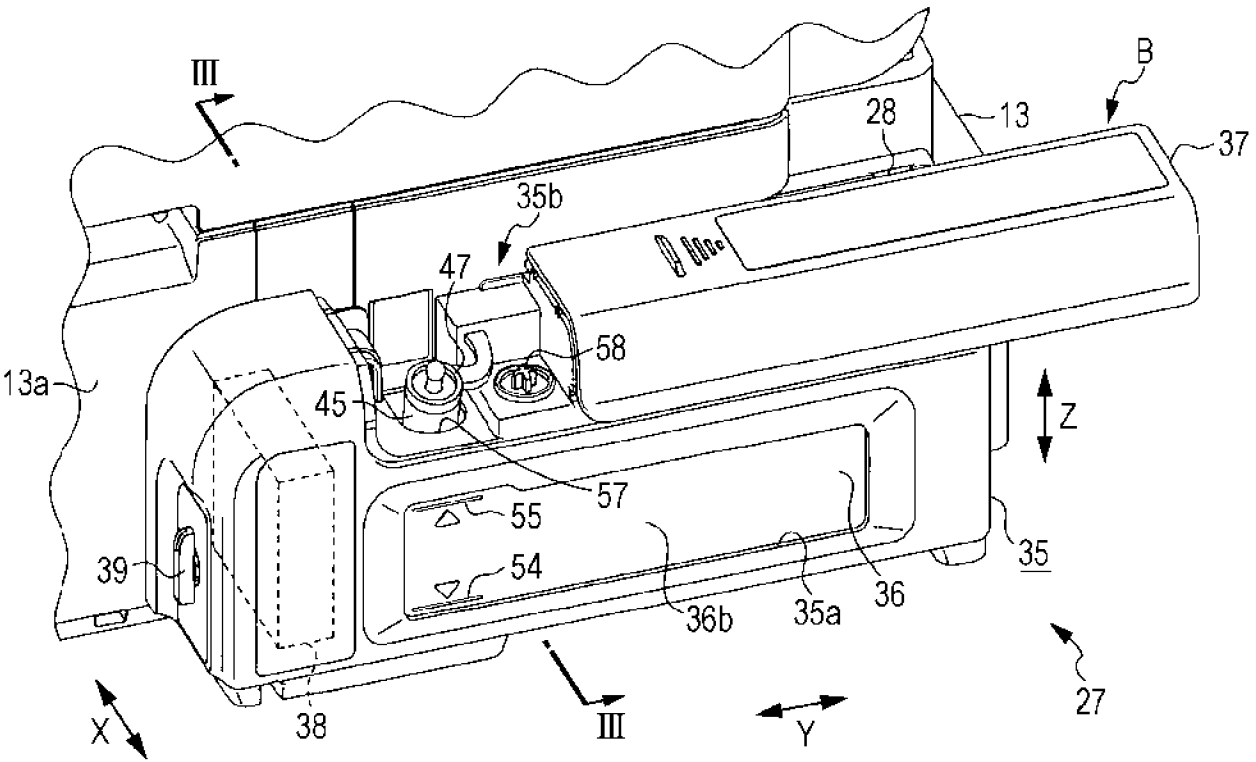
FIG. 2 is a perspective view illustrating a tank unit when seen from the front right side.

Hereinafter, the tank unit 27 as illustrated in FIG. 2 is described.

The right-left direction X, the front-rear direction Y, and the up-down direction Z of the tank unit 27 are based on the respective directions in a state where the tank unit 27 is attached to the device main body 13.

As illustrated in FIG. 2, the tank unit 27 includes a tank case 35 and an ink tank 36 as an example of a liquid accommodation member that is accommodated in the tank case 35. A window portion 35*a* having a substantially rectangular shape is formed on a wall portion forming an outer surface (in this case, right side surface) of the tank case 35 along the front-rear direction Y and the up-down direction Z. The window portion 35*a* communicates the inner side and the outer side of the tank case 35. Accordingly, a portion of the ink tank 36 is capable of being visually recognized from the outside of the tank case 35 through the window portion 35*a* in a state where the ink tank 36 is accommodated in the tank case 35.

Further, the tank unit 27 includes a cover 37 and a choke valve 38. The cover 37 is an example of a displacement member that moves in the front-rear direction Y in a sliding manner relative to the tank case 35. The choke valve 38 is accommodated in the tank case 35. A valve lever 39 for operating the choke valve 38 is provided on the front surface of the tank case 35. It is to be noted that the choke valve 38 presses the tube 31 with an operation of the valve lever 39 by a user so as to shut supply of the ink into the liquid ejecting head 32 from the ink tank 36.

Next, the ink tank 36 is described.

Figure 3:
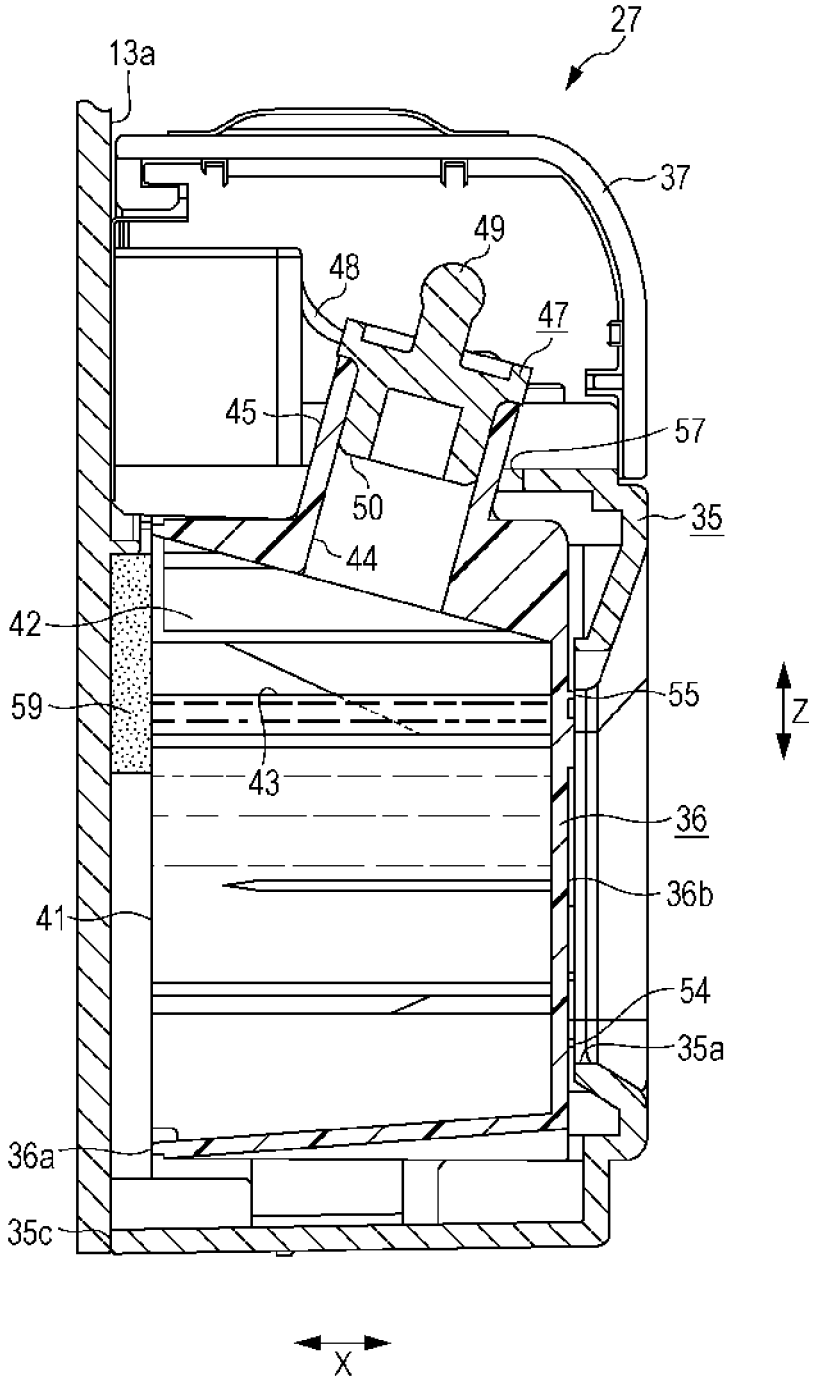
FIG. 3 is a cross-sectional view cut along a line III-III in FIG. 2.

As illustrated in FIG. 3, a film 41 is bonded to a tank opening 36*a* of the ink tank 36 so as to form an ink chamber 42 as an example of a liquid accommodation chamber that accommodates the ink.

Further, the ink tank 36 is made of a transparent or semi-transparent resin and ink accommodated in the ink chamber 42 and a liquid level 43 of the ink can be visually recognized from the outer side of the ink tank 36. Therefore, if the ink tank 36 is attached to the tank case 35, the ink accommodated in the ink chamber 42 can be visually recognized through the window portion 35*a* of the tank case 35 from the outer side. That is to say, a region on the right side surface of the ink tank 36, which corresponds to the window portion 35*a*, functions as a visual recognition surface 36*b* through which the liquid level 43 of the ink accommodated in the ink chamber 42 can be visually recognized from the right direction.

Further, an inlet port 44 is formed on an upper portion of the ink tank 36. The inlet port 44 is an example of a liquid inlet port through which ink can be injected into the ink chamber 42 from the outside. The inlet port 44 is formed so as to project to the outer side of the ink chamber 42 and open on the front end of a cylindrical portion 45. The cylindrical portion 45 projects toward the right upward direction that is not orthogonal to the up-down direction Z and is the upper direction relative to the horizontal direction.

As illustrated in FIG. 2 and FIG. 3, a closing member 47 is attached to the front end of the cylindrical portion 45 in a detachable manner. The closing member 47 can close the inlet port 44. One end of an anchor portion 48 is connected to the closing member 47 and the other end of the anchor portion 48 is connected to the tank case 35. Further, a knob portion 49 is formed on an upper portion of the closing member 47. A circular tube-like fitting portion 50 that is fitted into the inlet port 44 is formed on a lower portion of the closing member 47.

Figure 4:
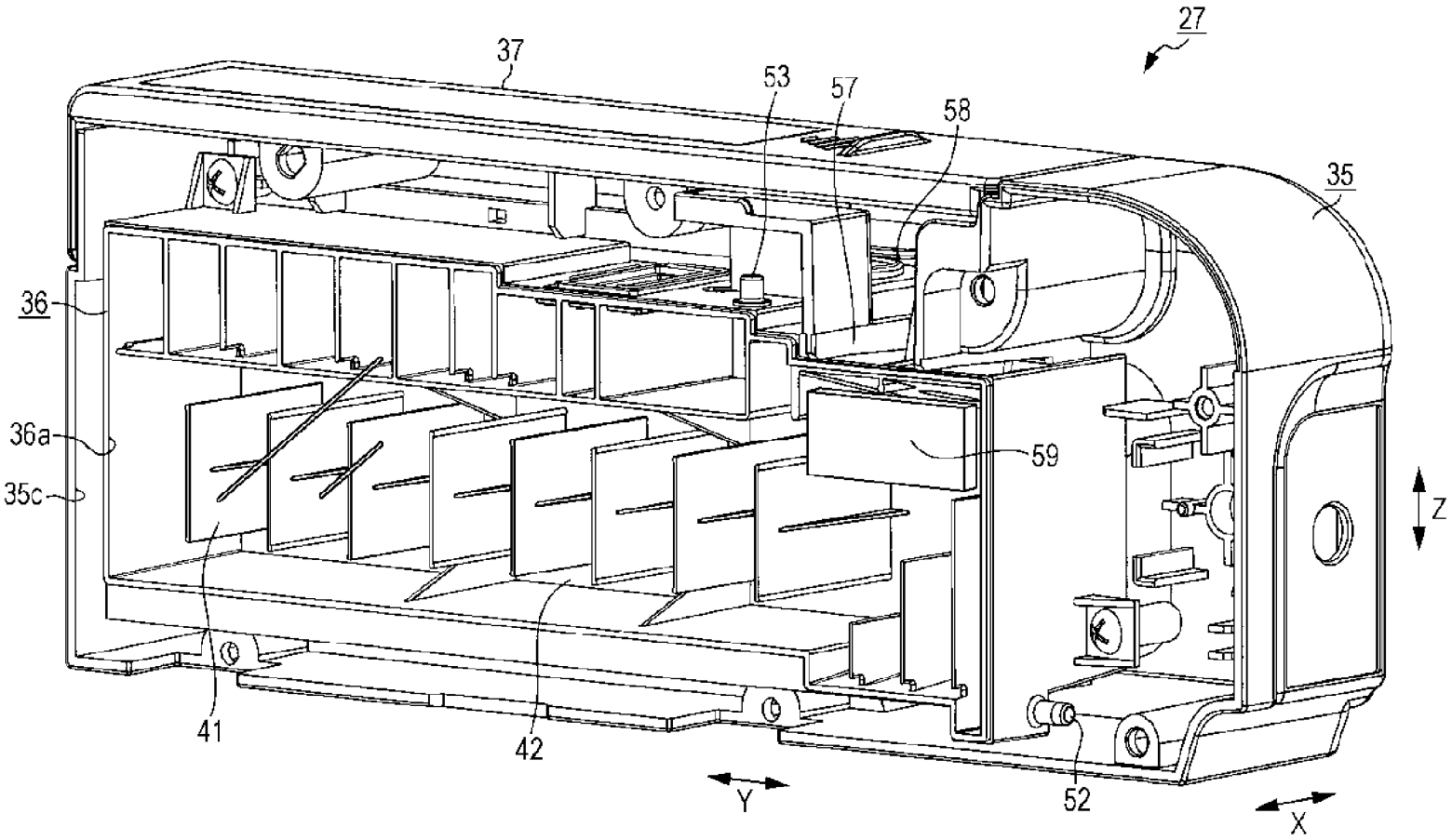
FIG. 4 is a perspective view illustrating the tank unit when seen from the front left side.

Further, as illustrated in FIG. 4, an outlet port 52 as an example of a liquid outlet port is formed on the front surface of the ink tank 36 at a lower position. The tube 31 (not illustrated in FIG. 4) is connected to the outlet port 52 and the outlet port 52 can lead ink to the liquid ejecting head 32 from the ink chamber 42. Moreover, an air intake port 53 that intakes the air into the ink chamber 42 is formed on an upper portion of the ink tank 36.

As illustrated in FIG. 2, a lower limit scale 54 and an upper limit scale 55 are formed on the visual recognition surface 36*b* at front-side positions in a projecting manner. The lower limit scale 54 and the upper limit scale 55 are formed at an interval in the up-down direction Z. It is to be noted that the lower limit scale 54 is a scale indicating a lower limit amount as an indicator for injecting ink into the ink chamber 42. Further, the upper limit scale 55 is a scale indicating an upper limit amount of ink that is injected through the inlet port 44 and is accommodated in the ink chamber 42.

Next, the tank case 35 is described.

As illustrated in FIG. 2 and FIG. 3, a valley portion 35*b* is formed on the upper surface of the tank case 35 at a front-side position. The height of the valley portion 35*b* in the up-down direction Z is lower than the upper surface by one step. A receiving portion 57 having a U shape when seen from the above is formed on the valley portion 35*b*. The receiving portion 57 receives enter of the cylindrical portion 45 in the valley portion 35*b* from the left side as the side of a case opening 35*c* when the ink tank 36 is attached to the tank case 35. Further, in the valley portion 35*b*, a rear portion of the receiving portion 57 is formed so as to be higher than the position at which the receiving portion 57 is formed by one step. A placement portion 58 on which the closing member 47 can be placed is formed on the rear portion of the receiving portion 57.

As illustrated in FIG. 3 and FIG. 4, an illumination portion 59 is provided on the side surface of the ink tank 36. To be more specific, the illumination portion 59 is provided on the side surface at the side opposite to the visual recognition surface 36*b* with respect to the ink chamber 42, that is, on the side surface formed by the surface of the film 41 bonded to the tank opening 36*a*. The illumination portion 59 is formed by a sheet-like light emitting member obtained by distributing a number of light emitting diodes (LED) in a planar form, for example. In the mode as illustrated in FIG. 3, a right side surface portion of the illumination portion 59 in the right-left direction X corresponds to a light emitting portion. In the embodiment, the illumination portion 59 is provided so as to illuminate the ink chamber 42 toward the side of the visual recognition surface 36*b* from the position at the rear side when the ink tank 36 is seen from the visual recognition surface 36*b*.

As illustrated in FIG. 4, the illumination portion 59 is provided at the front-side position at the side at which the lower limit scale 54, the upper limit scale 55 and the inlet port 44 are formed relative to the halfway position of the ink chamber 42 in the front-rear direction Y. Further, the illumination portion 59 is provided such that the light emitting portion (right side surface portion in FIG. 3) overall is located at the upper side relative to the lower limit scale 54 and the substantially upper half of the light emitting portion is located at the upper side relative to the upper limit scale 55. That is to say, the illumination portion 59 is arranged so as to illuminate the inner portion of the ink camber 42 from the upper position relative to the liquid level 43 of ink accommodated in the ink chamber 42 when the light emitting portion emits light. Note that at least a part of the light emitting portion of the illumination portion 59 is located at the upper side relative to the upper limit scale 55 preferably and the light emitting portion overall may be located at the upper side relative to the upper limit scale 55.

Next, actions of injection of ink into the ink chamber are described.

First, as illustrated in FIG. 1, it is assumed that a cover 37 is located at a hiding position A at which the cover 37 hides the cylindrical portion 45 provided with the inlet port 44 and the placement portion 58. That is to say, the cover 37 is located at the hiding position A at the time of the recording when ink accommodated in the ink chamber 42 is ejected from the liquid ejecting head 32 and at the time of non-injection when the ink is not injected through the inlet port 44. Accordingly, in the embodiment, the hiding position A corresponds to a liquid non-injection position at which the displacement member is located at the time of the liquid non-injection.

When a user injects ink into the ink chamber 42, the user moves the cover 37 located at the hiding position A to the rear side in the sliding manner so as to locate the cover 37 at a non-hiding position B as illustrated in FIG. 2. With this, the cylindrical portion 45 and the placement portion 58 hidden by the cover 37 will appear. Further, if the user displaces the closing member 47 attached to the cylindrical portion 45 on the placement portion 58, the inlet port 44 appears. That is to say, the non-hiding position B is a position at which the cover 37 is located at the time of the ink injection (an example of the time of liquid injection) when ink is injected through the inlet port 44. In the embodiment, the non-hiding position B corresponds to the liquid injection position at which the displacement member is located at the time of the liquid injection.

Further, if the cover 37 is displaced to the non-hiding position (liquid injection position) B from the hiding position (liquid non-injection position) A, a switch (not illustrated) is turned ON and the illumination portion 59 lights up. Therefore, the user can inject the ink through the inlet port 44 while visually recognizing the position of the liquid level 43 illuminated by the illumination portion 59.

If the user has injected the ink completely, the user puts the closing member 47 placed on the placement portion 58 back onto the cylindrical portion 45 and moves the cover 37 located at the non-hiding position B to the front side in the sliding manner so as to displace the cover 37 to the hiding position A. Then, the switch (not illustrated) is turned OFF and the illumination portion 59 lights off.

With the above-mentioned first embodiment, the following effects can be obtained.

1. When ink is injected into the ink chamber 42 through the inlet port 44, the cover 37 is displaced from the hiding position A and the illumination portion 59 lights up with the displacement of the cover 37 from the hiding position A. Therefore, the ink chamber 42 is illuminated by the illumination portion 59 when the ink is injected into the ink chamber 42. This makes it possible to visually recognize the position of the liquid level 43 of the ink accommodated in the ink tank 36 easily at the time of ink injection.

2. The illumination portion 59 illuminates the ink chamber 42 toward the side of the visual recognition surface 36*b* from the position at the rear side when seen from the side of the visual recognition surface 36*b*. Therefore, a light amount reaching the visual recognition surface 36*b* can be increased in comparison with the case where the ink chamber 42 is illuminated from another position. This makes it possible to visually recognize the position of the liquid level 43 of the ink accommodated in the ink chamber 42 more easily.

3. The illumination portion 59 is formed at the front side at which the inlet port 44 is formed relative to the halfway position of the visual recognition surface 36*b* in the front-rear direction Y. This makes it possible to visually recognize the ink that is injected more easily.

4. The illumination portion 59 is formed at the front side at which the lower limit scale 54 and the upper limit scale 55 are formed relative to the halfway position of the visual recognition surface 36*b* in the front-rear direction Y. This makes it possible to visually recognize the lower limit scale 54, the upper limit scale 55, and the liquid level 43 of the ink that is injected more easily. That is to say, the lower limit scale 54 and the liquid level 43 are easy to be compared. With this, the user can be notified of necessity of injection of the ink accurately. Further, the upper limit scale 55 and the liquid level 43 are easy to be compared, thereby reducing a risk that the ink is injected into the ink chamber 42 more than necessary and is spilled out of the inlet port 44.

5. At least a part of the illumination portion 59 (to be more specific, light emitting portion) is provided at the upper side relative to the upper limit scale 55. With this, the inner portion of the ink chamber 42 can be illuminated from the upper side relative to the liquid level 43 of the ink accommodated in the ink chamber 42. This enables the user to visually recognize the liquid level 43 easily in comparison with the case where the inner portion of the ink chamber 42 is illuminated from the lower side relative to the liquid level 43 of the ink.

Second Embodiment

Next, a second embodiment of an ink jet printer (hereinafter, also referred to as "printer") as an example of a liquid consumption device is described with reference to the accompanying drawings. Note that the configurations in the second embodiment, which are the same as those in the first embodiment, are denoted with the same reference numerals and overlapped explanation thereof is omitted.

Figure 5:
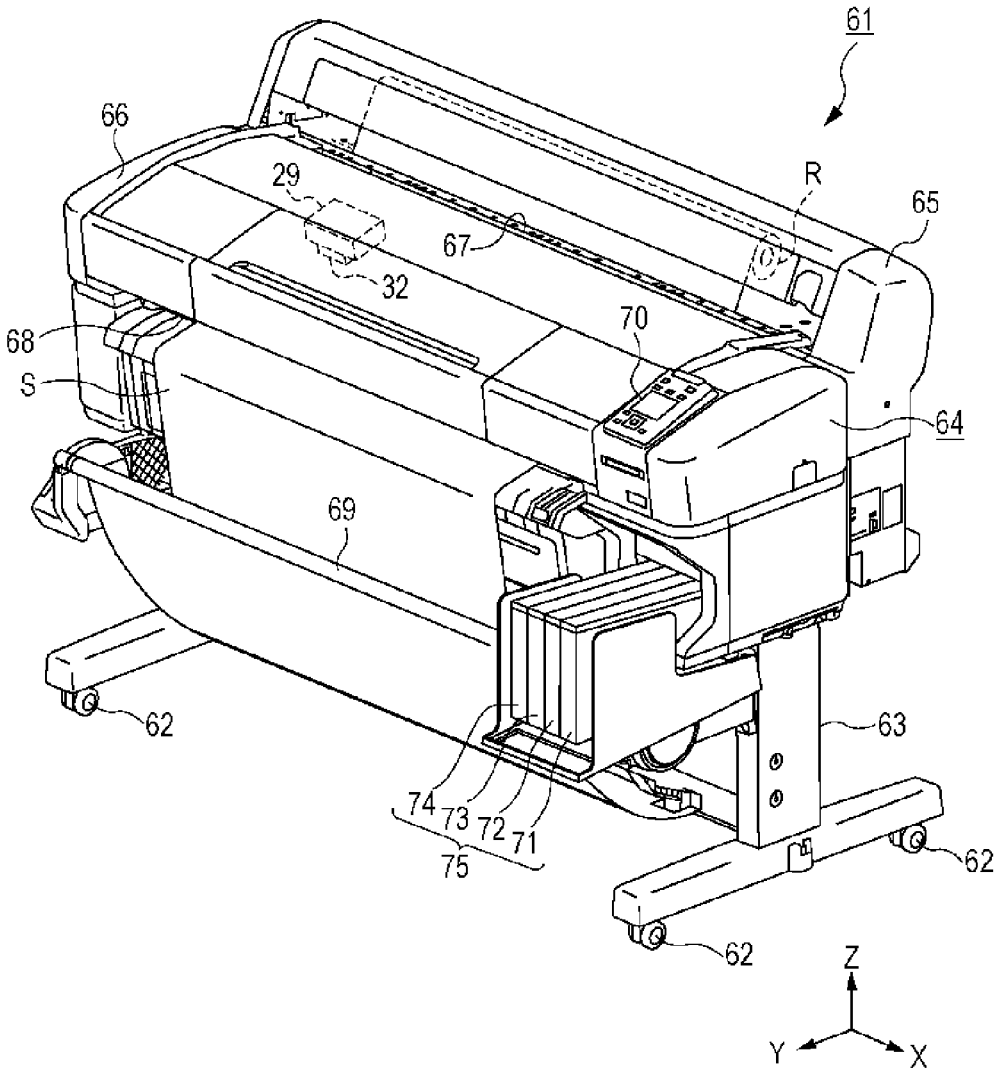
FIG. 5 is a perspective view illustrating a printer according to a second embodiment.

As illustrated in FIG. 5, a printer 61 in the embodiment includes leg portions 63 and a device main body 64 having a substantially rectangular parallelepiped. The leg portions 63 have wheels 62 on the lower ends thereof. The device main body 64 is assembled on the leg portions 63. A feeding portion 65 projecting upward is provided on a rear portion of the device main body 64. A roll sheet R obtained by winding and overlapping a sheet S as a long medium in a cylindrical form is loaded in the feeding portion 65. An insertion port 67 is formed on a housing 66 constituting an exterior of the device main body 64 at the front-side position of the feeding portion 65. The insertion port 67 introduces the sheet S that is fed from the feeding position 65 into the housing 66.

On the other hand, a discharge port 68 is formed at the front surface side of the device main body 64. The discharge port 68 is a port for discharging the sheet S to the outside of the housing 66. A medium transportation mechanism (not illustrated) is accommodated in the housing 66. The medium transportation mechanism transports the sheet S fed from the feeding portion 65 toward the side of the discharge port 68 from the side of the insertion port 67. Then, a medium receiving unit 69 is provided at the front surface side of the device main body 64 at a lower position relative to the discharge port 68. The medium receiving unit 69 receives the sheet S discharged from the discharge port 68.

Further, an operation panel 70 for performing a setting operation and an input operation is provided on an upper portion of the device main body 64 at one end side (right end side in FIG. 5) at the outer side of the transportation path of the sheet S in the right-left direction X. Further, ink tanks 71 to 74 as an example of a liquid accommodation member capable of accommodating ink are fixed onto a lower portion of the device main body 64 at one end side (right end side in FIG. 5) at the outer side of the transportation path of the sheet S in the right-left direction X.

At least two (in the embodiment, four) ink tanks 71 to 74 are provided so as to correspond to types and colors of inks. The ink tanks 71 to 74 are arranged so as to align in the right-left direction X to constitute an accommodation member unit 75 as an example of a liquid accommodation member unit.

The respective ink tanks 71 to 74 have the same configuration. Therefore, the configuration of the first ink tank 71 is described below and description of the second ink tank 72 to the fourth ink tank 74 is omitted.

Figure 6:
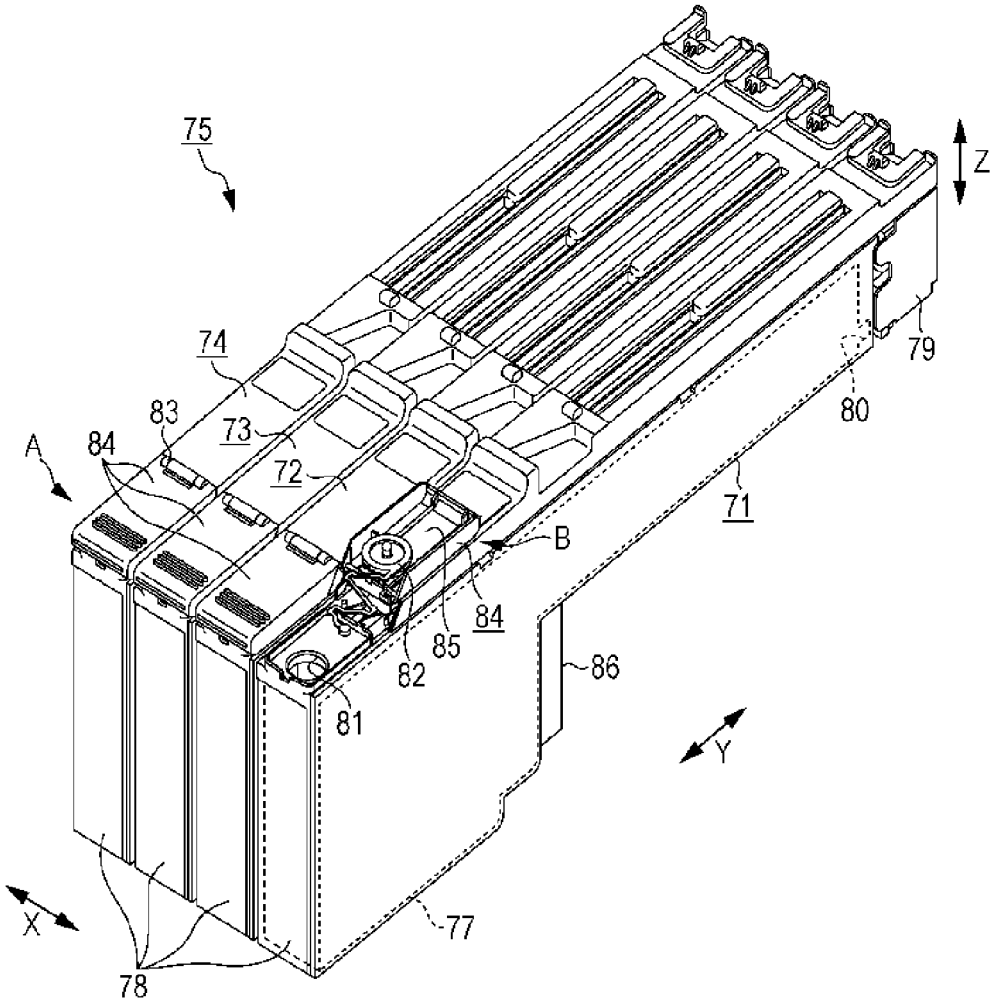
FIG. 6 is a perspective view illustrating an accommodation member unit.

As illustrated in FIG. 6, at least the front surface of the ink tank 71 is made of a transparent or semi-transparent resin and ink accommodated in an ink chamber 77 and a liquid level (not illustrated) of the ink can be visually recognized from the front side of the ink tank 71. That is to say, if the ink tank 71 is attached to the device main body 64, the front surfaces of the ink tanks 71 to 74 function as a visual recognition surface 78 through which the liquid levels (not illustrated) of the inks accommodated in ink chambers 77 can be visually recognized from the front direction.

A residual amount detector 79 that detects a residual amount of ink accommodated in the ink chamber 77 is provided on the ink tank 71. The ink accommodated in the ink chamber 77 passes through the residual amount detector 79 when the ink is led to the side of the liquid ejecting head 32 through an outlet port 80 as an example a liquid outlet port.

Further, an inlet port 81 as an example of a liquid inlet port is formed on an upper portion of the ink tank 71. The inlet port 81 is a port through which ink can be injected into the ink chamber 77 from the outside. In addition, a closing member 82 and a cover 84 as an example of a displacement member are provided on an upper portion of the ink tank 71. The closing member 82 can close the inlet port 81. The cover 84 is moved rotationally about a shaft 83.

That is to say, the cover 84 is displaced between a hiding position A and a non-hiding position B in a rotationally movable manner. The covers 84 of the second ink tank 72 to the fourth ink tank 74 as illustrated in FIG. 6 are located at the hiding position A. The cover 84 of the first ink tank 71 as illustrated in FIG. 6 is located at the non-hiding position B. The cover 84 located at the hiding position A hides the inlet port 81 and the closing member 82 closing the inlet ports 81. It is to be noted that the cover 84 is located at the hiding position A at the time of recording or non-injection.

On the other hand, the cover 84 is located at the non-hiding position B at the time of ink injection. The rear side of the cover 84 located at the non-hiding position B serves as a placement portion 85 on which the closing member 82 can be placed.

Further, as the size of the ink tank 71 in the up-down direction Z, a rear portion thereof is smaller than a front portion thereof. An illumination portion 86 is provided on the rear surface of the front portion having the larger size in the up-down direction Z. That is to say, the illumination portion 86 is provided on the surface opposite to the visual recognition surface 78 with respect to the ink chamber 77 of the ink tank 71 at the rear side when seen from the side of the visual recognition surface 78.

Next, actions of injection of ink into the ink chamber 77 of the first ink tank 71 are described.

It is assumed that the cover 84 is located at the hiding position A. When a user injects ink into the ink chamber 77, the user rotationally moves the cover 84 located at the hiding position A to the rear side so as to displace the cover 84 to the non-hiding position B in a rotationally movable manner. With this, the closing member 82 and the placement portion 85 that are hidden by the cover 84 appear. Further, if the user displaces the closing member 82 onto the placement portion 85, the inlet port 81 appears.

If the cover 84 is displaced to the non-hiding position B from the hiding position A, a switch (not illustrated) is turned ON and the illumination portion 86 of the first ink tank 71 corresponding to the cover 84 displaced to the non-hiding position B lights up. On the other hand, the illumination portions 86 of the second ink tank 72 to the fourth ink tank 74 of which covers 84 are located at the hiding position A are kept to be in the state of lighting off. Then, the user injects the ink through the inlet port 81 of the first ink tank 71 while visually recognizing the position of the liquid level (not illustrated) illuminated by the illumination portion 86.

If the user has injected the ink completely, the user puts the closing member 82 placed on the placement portion 85 back onto the inlet port 81 and rotationally moves the cover 84 located at the non-hiding position B to the front side so as to displace the cover 84 to the hiding position A. Then, the switch (not illustrated) is turned OFF and the illumination portion 86 of the first ink tank 71 lights off.

With the above-mentioned second embodiment, the following effects can be obtained.

6. Each illumination portion 86 lights up with the displacement of the corresponding cover 84 from the hiding position A. Therefore, each ink camber 77 is illuminated by the illumination portion 86 when ink is injected into the ink chamber 77. Accordingly, at the time of ink injection into at least two ink tanks of the ink tanks 71 to 74, the positions of the liquid levels of inks accommodated in the respective ink tanks 71 to 74 can be visually recognized for each of the ink tanks 71 to 74 easily.

7. The illumination portion 86 corresponding to the ink tank 71, 72, 73 or 74 of which cover 84 has been displaced from the hiding position A in at least two ink tanks of the ink tanks 71 to 74 lights up. That is, the illumination portions 86 light up selectively. This makes it possible to visually recognize the positions of the liquid levels of the inks accommodated in the ink tanks 71 to 74 into which the inks are injected easily while ensuring power saving performance.

It is to be noted that the above-mentioned embodiments may be changed as follows.

In each of the above-mentioned embodiments, even when the cover 37 or 84 is displaced to a position other than the non-hiding position B from the hiding position A, the illumination portion 59 or 86 may light up while the cover 37 or 84 is considered to be displaced from the hiding position A. Further, when the cover 37 or 84 is located at the non-hiding position B, the illumination portion 59 or 86 may light up while the cover 37 or 84 is considered to be displaced from the hiding position A.

In each of the above-mentioned embodiments, a sensor that detects displacement of the cover 37 or 84 may be provided. That is to say, the illumination portion 59 or 86 may be made to light up by detecting the displacement of the cover 37 or 84 with the sensor.

In each of the above-mentioned embodiments, the illumination portion 59 or 86 may light off with the displacement of the cover 37 or 84 from the non-hiding position B. Further, the illumination portion 59 or 86 may light off when the cover 37 or 84 is located at the hiding position A.

In the above-mentioned second embodiment, one illumination portion 86 may be provided for the accommodation member unit 75. Alternatively, one illumination portion 86 may be provided for at least two ink tanks of the ink tanks 71 to 74. That is to say, for example, one illumination portion 86 may be provided so as to correspond to the first ink tank 71 and the second ink tank 72. Moreover, one illumination portion 86 may be provided so as to correspond to the first ink tank 71 to the third ink tank 73.

Further, one cover 84 may be provided for the accommodation member unit 75. Alternatively, one cover 84 may be provided for at least two ink tanks of the ink tanks 71 to 74. That is to say, for example, one cover 84 may be provided so as to correspond to the first ink tank 71 and the second ink tank 72. Moreover, one cover 84 may be provided so as to correspond to the first ink tank 71 to the third ink tank 73.

For example, one illumination portion 86 provided for the accommodation member unit 75 may light up with displacement of one cover 84 provided for the accommodation member unit 75 from the hiding position A. Alternatively, one illumination portion 86 provided for the first ink tank 71 and the second ink tank 72 may light up with displacement of one cover 84 provided so as to correspond to the first ink tank 71 and the second ink tank 72 from the hiding position A, for example.

In addition, the number of illumination portions 86 and the number of covers 84 that are provided for the accommodation member unit 75 may be different. For example, one illumination portion 86 is provided so as to correspond to the first ink tank 71 and the second ink tank 72 or two covers 84 may be provided so as to correspond to the first ink tank 71 and the second ink tank 72 individually. In this case, the illumination portion 86 may light up with displacement of at least one cover 84 of the two covers 84 from the hiding position A.

In each of the above-mentioned embodiments, at least two ink chambers 42 or 77 may be provided on each ink tank 36 or 71 to 74. In this case, the illumination portions 59 or 86 may be provided for the respective ink chambers 42 or 77 individually. Alternatively, the illumination portion 59 or 86 may be provided for each ink tank 36 or 71 to 74 having at least two ink chambers 42 or 77.

In each of the above-mentioned embodiments, the illumination portion 59 or 86 may be provided on the device main body 13 or 64. Further, the illumination portion 59 or 86 may be provided in the ink chamber 42 or 77. Alternatively, for example, a recessed portion may be formed on the upper surface or the side surface of the ink tank 36 or 71 to 74 and the illumination portion 59 or 86 may be provided in the recessed portion. With this configuration, the liquid level 43 can be illuminated at a position closer to the visual recognition surface 36*b* or 78. This makes it possible to visually recognize the liquid level of the ink more easily. In addition, in the above-mentioned first embodiment, the illumination portion 59 may be provided on the tank case 35.

In each of the above-mentioned embodiments, if the illumination portion 59 or 86 can be provided at an arbitrary position as long as the illumination portion can illuminate the ink chamber 42 or 77. For example, the illumination portion 59 or 86 may be provided on the upper surface, the side surface other than the visual recognition surface, or the bottom surface of the ink tank 36 or 71 to 74. For example, the illumination portion 59 may be formed to extend along the front-rear direction Y so as to illuminate the overall region of the ink chamber 42 or 77 in the front-rear direction Y. Further, the illumination portion 59 or 86 may be formed to extend along the up-down direction Z so as to illuminate the overall region of the ink chamber 42 or 77 in the up-down direction Z. Alternatively, the illumination portion 59 or 86 may be provided at the lower position relative to the upper limit scale 55 in the up-down direction Z. In addition, the illumination portion 59 or 86 may be provided at the lower position relative to the lower limit scale 54 in the up-down direction Z. Further, at least two illumination portions 59 or 86 may be provided for one ink tank 36 or 71 to 74.

In each of the above-mentioned embodiments, the closing member 47 or 82 may be made to function as an example of the displacement member. That is to say, the closing member 47 or 82 is located at a closing position (an example of a liquid non-injection position) at which the closing member closes the inlet port 44 or 81 at the time of recording and non-injection. The closing member 47 or 82 is located at a non-closing position (an example of a liquid injection position) at the time of ink injection. Accordingly, the illumination portion 59 or 86 may light up with displacement of the closing member 47 or 82 from the closing position. Further, when the closing member 47 or 82 is placed on the placement portion 58 or 85, the illumination portion 59 or 86 may light up while the closing member 47 or 82 is considered to be displaced from the closing position.

In each of the above-mentioned embodiments, the tank unit 27 or the accommodation member unit 75 may be attached to the device main body 13 or 64 in a detachable manner. The accommodation member unit 75 may be configured such that the ink tanks 71 to 74 are detachable from the device main body 64 individually. Further, the illumination portion 59 or 86 may light up with the detachment of the tank unit 27, the accommodation member unit 75, or the ink tanks 71 to 74 from the device main body 13 or 64. In this case, the case itself constituting the tank case 35 or the ink tank 36 or 71 to 74 functions as an example of the displacement member. The position of the case itself in a state of being attached to the device main body 13 or 64 corresponds to the liquid non-injection position and the position thereof in a state of being detached from the device main body 13 or 64 corresponds to the liquid injection position.

In the above-mentioned second embodiment, if the residual amount detectors 79 detect that amounts of inks accommodated in the ink chambers 77 are smaller than a lower limit threshold value, the residual amount detectors 79 may notify a user of necessity of ink injection by using the corresponding illumination portions 86. That is to say, the corresponding illumination portions 86 may be made to light up or flash, for example. Further, only the illumination portion 86 for the ink tank in which residual amount is reduced among the ink tanks 71 to 74 may be made to light up or flash. Further, if the residual amount detectors 79 detect that the amounts of inks accommodated in the ink chambers 77 are larger than an upper limit threshold value, the residual amount detectors 79 may notify the user of termination of the ink injection by using the illumination portions 86. For example, the illumination portion 86 may be made to light off or flash.

In each of the above-mentioned embodiments, the illumination portion 59 or 86 may be made to light up periodically. For example, the illumination portion 59 or 86 may be made to light up for a constant period of time when the complex machine 11 or the printer 61 is powered ON or OFF. Further, the illumination portion 59 or 86 may be made to light up depending on the positions of the carriage 29. To be more specific, for example, the illumination portion 59 or 86 may be made to light up when the carriage 29 is located at a home position deviated from the transportation path of the paper P or S for a constant period of time.

In each of the above-mentioned embodiments, a switch for lighting the illumination portion 59 or 86 up may be included. That is to say, a configuration in which the user operates the switch so as to light the illumination portion 59 or 86 up and off may be employed.

In the above-mentioned first embodiment, the valve lever 39 may be made to function as an example of the displacement member. To be more specific, if ink is injected into the ink chamber 42 in a state where the choke valve 38 presses the tube 31, there arises a risk that change in the pressure applied to the ink when the ink is injected vigorously is transmitted to the liquid ejecting head 32 through the tube 31. Then, at the time of the ink injection, the valve lever 39 may be located at the close position (an example of the liquid injection position) and press the tube 31. Further, the valve lever 39 may be located at the open position (an example of the liquid non-injection position) so as to supply the ink to the liquid ejecting head 32 at the time of the recording and non-injection. In this case, the illumination portion 59 may light up with displacement of the valve lever 39 from the open position.

In each of the above-mentioned embodiments, the illumination portion 59 or 86 can be selected arbitrarily as long as the illumination portion emits light. For example, a fairy light, a light-emitting diode (LED), a cold-cathode tube, a fluorescent tube, an optical fiber, or the like can be used as the illumination portion 59 or 86. When the optical fiber is used, one end of the optical fiber connected to a light source provided on a main board of the complex machine 11 or the printer 61 or an operation board of the operation panel 19 or 70 may be made to extend to the ink tank 36 or ink tanks 71 to 74.

In the above-mentioned first embodiment, the ink tank 36 may be provided in the device main body 13. Further, in the above-mentioned second embodiment, the ink tanks 71 to 74 constituting the accommodation member unit 75 may be provided at different positions at an interval.

In each of the above-mentioned embodiments, the liquid consumption device may be a liquid consumption device that ejects, discharges, or applies liquid other than the ink so as to consume the liquid. The state of liquid which is discharged from the liquid consumption device for a trace amount of liquid droplets includes a granule form, a teardrop form, and a form that pulls tails in a string-like form therebehind. The terminology "liquid" here represents materials which can be consumed by the liquid consumption device. For example, any materials are included as long as the materials are in a liquid phase. For example, materials in a liquid state having high viscosity or low viscosity or a fluid state such as sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment or metal particles. Typical examples of the liquid are ink described in the above embodiments and liquid crystals. The terminology "ink" here encompasses various liquid compositions such as common aqueous ink and oil ink, gel ink and hot melt ink. Specific examples of the liquid consumption device include a liquid ejecting apparatus which ejects liquid in a form of a dispersion or a solution of a material such as an electrode material or a coloring material. The material such as the electrode material or the coloring material is used for manufacturing a liquid crystal display, an electroluminescence (EL) display, a surface emitting display or a color filter, for example. Further, the specific examples of the liquid ejecting apparatus include a liquid ejecting apparatus which ejects a bioorganic material to be used for manufacturing a biochip, a liquid ejecting apparatus which ejects liquid to be used as a precision pipette and serving as a sample, a printing device and a micro dispenser. Other examples of the liquid ejecting apparatus include a liquid ejecting apparatus which pinpoint-ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) to be used for an optical communication element and the like is included as the liquid ejecting apparatus. In addition, a liquid ejecting apparatus which ejects an acid or alkali etching solution for etching a substrate or the like may be employed as the liquid ejecting apparatus.

Further, the liquid accommodation member and the liquid accommodation member unit may be a liquid accommodation member and a liquid accommodation member unit that accommodate liquid to be supplied to these liquid consumption devices.

The entire disclosure of Japanese Patent Application No. 2012-228640, filed Oct. 16, 2012 is expressly incorporated by reference herein.

What is claimed is:

1. A liquid accommodation member comprising:

a liquid accommodation chamber that accommodates liquid to be supplied to a liquid consumption portion for consuming the liquid;

a liquid outlet port that is capable of leading the liquid to the liquid consumption portion from the liquid accommodation chamber;

a liquid inlet port through which the liquid is capable of being injected into the liquid accommodation chamber from the outside;

a visual recognition surface through which a liquid level of the liquid accommodated in the liquid accommodation chamber is capable of being visually recognized;

an illumination portion that illuminates the liquid accommodation chamber, and a displacement member that is displaced between a time of liquid injection at which the liquid is injected through the liquid inlet port and a time of liquid non-injection at which the liquid is not injected, wherein the illumination portion lights up when the displacement member is displaced from a liquid non-injection position at which the displacement member is located at the time of the liquid non-injection.

2. The liquid accommodation member according to claim 1, wherein the illumination portion illuminates the liquid accommodation chamber toward a side of the visual recognition surface from a side opposite to the visual recognition surface with respect to the liquid accommodation chamber.

3. A liquid accommodation member unit comprising:

at least two liquid accommodation members each of which includes:

a liquid accommodation chamber that accommodates liquid to be supplied to a liquid consumption portion for consuming the liquid;

a liquid outlet port that is capable of leading the liquid to the liquid consumption portion from the liquid accommodation chamber;

a liquid inlet port through which the liquid is capable of being injected into the liquid accommodation chamber from the outside, and a visual recognition surface through which a liquid level of the liquid accommodated in the liquid accommodation chamber is capable of being visually recognized, an illumination portion that illuminates each liquid accommodation chamber, and a displacement member that is displaced between a time of liquid injection at which the liquid is injected through the liquid inlet port and a time of liquid non-injection at which the liquid is not injected, wherein the illumination portion lights up when the displacement member is displaced from a liquid non-injection position at which the displacement member is located at the time of the liquid non-injection.

4. The liquid accommodation member unit according to claim 3, wherein the illumination portion and the displacement member are provided so as to correspond to each of at least two liquid accommodation members individually, and in at least two illumination portions, the illumination portion for illuminating the liquid accommodation member corresponding to the displacement member that is displaced from the liquid non-injection position in at least two displacement members lights up.

5. A liquid consumption device comprising:

a liquid consumption portion for consuming liquid;

a liquid accommodation chamber that accommodates the liquid to be supplied to the liquid consumption portion;

a liquid outlet port that is capable of leading the liquid to the liquid consumption portion from the liquid accommodation chamber;

a liquid inlet port through which the liquid is capable of being injected into the liquid accommodation chamber from the outside;

a visual recognition surface through which a liquid level of the liquid accommodated in the liquid accommodation chamber is capable of being visually recognized;

an illumination portion that illuminates the liquid accommodation chamber; and a displacement member that is displaced between a time of liquid injection at which the liquid is injected through the liquid inlet port and a time of liquid non-injection at which the liquid is not injected, wherein the illumination portion lights up when the displacement member is displaced from a liquid non-injection portion at which the displacement member is located at the time of the liquid non-injection.

* * * * *